United States Patent [19]

Mudge

[11] Patent Number: 4,702,957

[45] Date of Patent: Oct. 27, 1987

[54] BINDERS FOR NONWOVENS BASED ON EVA-MALEATE COPOLYMERS

[75] Inventor: Paul R. Mudge, Somerville, N.J.

[73] Assignee: National Starch and Chemical Corporation, Bridgewater, N.J.

[21] Appl. No.: 905,353

[22] Filed: Sep. 8, 1986

[51] Int. Cl.[4] ..... B32B 27/00

[52] U.S. Cl. ..... 428/288; 5/482; 5/487; 5/499; 5/502; 8/181; 8/184; 427/394; 427/396; 427/389.9; 427/392; 428/290; 604/365; 604/374; 604/375; 604/377

[58] Field of Search ..... 8/181, 184; 427/392, 427/389.9, 394, 396; 428/288, 290; 604/365, 374, 375, 377

[56] References Cited

U.S. PATENT DOCUMENTS

| | | | |
|---|---|---|---|
| 2,965,617 | 12/1960 | MacDonald et al. . | |
| 3,337,482 | 8/1967 | Watanabe et al. | 260/8 |
| 3,380,851 | 4/1968 | Lindemann et al. . | |
| 3,483,171 | 12/1969 | Kuhlkamp et al. . | |
| 3,501,440 | 3/1970 | Kamio et al. . | |
| 3,639,326 | 2/1972 | Kray et al. . | |
| 3,657,174 | 4/1972 | Glabisch et al. . | |
| 3,755,237 | 8/1973 | Isaacs et al. . | |
| 3,823,108 | 7/1974 | Bissot et al. . | |
| 3,923,752 | 12/1975 | Guse et al. . | |
| 4,610,920 | 9/1986 | Mudge et al. | 428/288 |

FOREIGN PATENT DOCUMENTS

| | | |
|---|---|---|
| 1122879 | 8/1968 | United Kingdom . |
| 1188635 | 4/1970 | United Kingdom . |

OTHER PUBLICATIONS

CA96(22)184028b; Chemical Abstract; Sanyo Chemical Industries, Ltd., patent application No. JP 56/167791, "Low-Temperature Flow Improvers".

CA102(8):64744c; Chemical Abstract: Mitsubishi Electric Corp., patent application No. JP 59/138695, "Pour Point Depressants for Crude Petroleum".

*Primary Examiner*—James C. Cannon

*Attorney, Agent, or Firm*—Ellen T. Dec; Edwin M. Szala

[57] ABSTRACT

Nonwoven fabrics characterized by a superior balance of strength and softness are formed utilizing an aqueous emulsion prepared by the emulsion polymerization of a vinyl ester of an alkanoic acid interpolymerized with: 10 to 30% by weight ethylene; 15 to 40% by weight of $C_4$–$C_{10}$ dialkyl maleate; and 1 to 5% by weight of copolymerizable N-methylol containing monomer.

20 Claims, No Drawings

BINDERS FOR NONWOVENS BASED ON EVA-MALEATE COPOLYMERS

BACKGROUND OF THE INVENTION

Nonwoven fabrics, or nonwovens, have gained great acceptance in the industry for a wide range of applications, particularly as replacements for woven fabrics in constructions such as for facings or topsheets in diapers, incontinent pads, bed pads, sanitary napkins, hospital gowns, disposable wipes, and other single and multi-use nonwovens. For such uses it is desirable to produce a nonwoven which closely resembles the drape, flexibility and softness (hand) of a textile and yet is as strong as possible even when wet.

When an adhesive binder is used to bond the loosely assembled webs of fibers in the nonwoven, the particular binder employed plays an important role in determining the final properties of the nonwoven since it contributes to the presence or absence of a wide range of properties including the wet and dry tensile, tear strength, softness, absorbency, and resilience as well as the visual aesthetics. Acrylic latices have generally been used as binders where softness is the most important criteria, however the resultant nonwovens have suffered in strength. Ethylene/vinyl acetate-based binders yield the necessary strength properties but are deficient in softness for some applications requiring extreme softness. Efforts have been made to soften the ethylene/vinyl acetate binders by interpolymerization with the appropriate acrylate functionalities; however, this has also only been acomplished with a consequent reduction in the strength of the binder. As a result of this loss in strength, no more than 25% by weight acrylate functional had been employed in ethylene/vinyl acetate based binders for non-wovens.

Copending application Ser. No. 749,208 filed June 27, 1985, now U.S. Pat. No. 4,610,920, teaches the preparation of ethylene/vinyl acetate/acrylate/N-methylol copolymers containing higher levels of acrylates and the use thereof as nonwoven binders.

SUMMARY OF THE INVENTION

We have now found that latex binders for use in forming nonwovens can be prepared by the emulsion polymerization of a vinyl ester of an alkanoic acid interpolymerized with:

- 10 to 30% by weight ethylene;
- 15 to 40% by weight of a $C_4$–$C_{10}$ dialkyl maleate;
- 1 to 5% by weight of copolymerizable N-methylol containing monomer;
- 0 to 4% by weight of an olefinically-unsaturated carboxylic acid containing 3 to 6 carbon atoms; and
- 0 to 1% by weight of a polyolefinically unsaturated comonomer, the total of the aforementioned comonomers equalling 100% by weight.

Surprisingly, nonwovens prepared with these binders possess the desirable softness characteristic of binders containing high acrylate content, with no reduction, indeed often with improvement, in the tensile strength properties even after wetting.

DESCRIPTION OF THE PREFERRED EMBODIMENTS

The vinyl esters utilized herein are the esters of alkanoic acids having from one to about 13 carbon atoms. Typical examples include: vinyl formate, vinyl acetate, vinyl propionate, vinyl butyrate, vinyl isobutyratre, vinyl valerate, vinyl 2-ethyl-hexanoate, vinyl isooctanoate, vinyl nonoate, vinyl decanoate, vinyl pivalate, vinyl versatate, etc. Of the foregoing, vinyl acetate is the preferred monomer because of its ready availability and low cost.

The N-methylol component is generally N-methylol acrylamide although other mono-olefinically unsaturated compounds containing an N-methylol group and capable of copolymerizing with ethylene and the vinyl ester ester may also be employed. Such other compounds include, for example, N-methylol methacrylaide or lower alkanol ethers thereof, or mixtures thereof.

The dialkyl maleate monomers used herein include the $C_4$ to $C_{10}$ dialkyl maleates such as di-2-ethyhexyl maleate, di-n-octyl maleate, di-iso-octyl maleate, dimethylamyl maleate, di-butyl maleate and di-isodecyl maleate. Particularly preferred are the $C_6$–$C_{10}$ dialkyl maleates and more particularly the $C_8$ dialkyl maleates. Due to its commercial availability, di-2-ethylhexyl maleate is most generally used. Since, after polymerization, the structure of the fumarate and maleate (cis and trans isomers) are the same, the corresponding fumarate esters are also comtemplated for use herein. While amounts of the dialkyl maleate in excess of about 15% are beneficial, levels of at least about 20% are preferred.

The olefinically-unsaturated carboxylic acids which may optionally be present are the alkenoic acids having from 3 to 6 carbon atoms or the alkenedioic acids having from 4 to 6 carbon atoms, including acrylic acid, methacrylic acid, crotonic acid, itaconic acid, maleic acid or fumaric acid, or mixtures thereof in amounts sufficient to provide up to about 4% by weight, preferably 1 to 2.5% by weight in the final copolymer.

Optionally, polyunsaturated copolymerizable monomers may also be present in small amounts, i.e., up to about 1% by weight. Such comonomers would include those polyolefinically-unsaturated monomers copolymerizble with vinyl acetate and ethylene, for example, vinyl crotonate, allyl acrylate, allyl methacrylate diallyl maleate, divinyl adipate, diallyl adipate, diallyl phthalate, ethylene glycol diacrylate, ethylene glycol dimethacrylate, butanediol dithacrylate, methylene bis-acrylamide, triallyl cyanurate, etc. In addition, certain copolymerizable monomers which assist in the stability of the copolymer emulsion, e.g., 2-acrylamide-2 -methylpropane sulfonic acid and vinyl sulfonic acid, are also useful herein as latex stabilizers. These optionally present monomers, if employed, are added in very low amounts of from 0.1 to about 2% by weight of the monomer mixture.

Conventional batch, semi-batch or continuous emulsion polyerization procedures may be utilized herein. Generally, the monomers are polymerized in an aqueous medium under pressures not exceeding 100 atmospheres in the presence of a catalyst and at least one emulsifing agent.

The quantity of ethylene entering into the copolymer is influenced by the pressure, the agitation, and the viscosity of the polymerization medium. Thus, to increase the ethylene content of the copolymer, higher pressures are employed. A pressure of at least about 10 atmospheres is most suitably employed. The mixture is thoroughly agitated to dissolve the ethylene, agitation being continued until substantial equilibrium is achieved. This generally requires about 15 minutes; however, less time may be required depending upon the vessel, the efficiency of agitation, the specific system, and the like.

Suitable as polymerization catalysts are the water-soluble free-radical-formers generally used in emulsion polymerization, such as hydrogen peroxide, sodium persulfate, potassium persulfate and ammonium persulfate, as well as tert-butyl hydroperoxide, in amounts of between 0.01 and 3% by weight, preferably 0.01 and 1% by weight based on the total amount of the emulsion. They can be used alone or together with reducing agents such as sodium formaldehyde-sulfoxylate, ferrous salts, sodium dithionite, sodium hydrogen sulfite, sodium sulfite, sodium thiosulfate, as redox catalysts in amounts of 0.01 to 3% by weight, preferably 0.01 to 1% by weight, based on the total amount of the emulsion. The free-radical-formers can be charged in the aqueous emulsifier solution or be added during the polymerization in doses.

The polyerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkali metal phosphates. Polymerization regulators, like mercaptans, aldehydes, chloroform, ethylene chloride and trichloroethylene, can also be added in some cases.

The emulsifying agents are those generally used in emulsion polymerization, as well as optionally present protective colloids. It is also possible to use emulsifiers alone or in mixtures with protective colloids.

The emulsifiers can be anionic, cationic, nonionic surface-active compounds or mixtures thereof. Suitable anionic emulsifiers are, for example, alkyl sulfonates, alkylaryl sulfonates, alkyl sulfates, sulfates of hydroxylalkanols, alkyl and alkylaryl disulfonates, sulfonated fatty acids, sulfates and phosphates of polyethyoxylated alkanols and alkyphenols, as well as esters of sulfosuccinic acid. Suitable cationic emulsifiers are, for example, alkyl quaternary ammonium salts, and alkyl quaternary phosphonium salts. Examples of suitable nonionic emulsifiers are the addition products of 5 to 50 mols of ethylene oxide adducted to straight-chained and branch-chained alkanols with 6 to 22 carbon atoms, or alkylphenols, or higher fatty acids, or higher fatty acid amides, or primary and secondary higher alkyl amines; as well as block copolymers of propylene oxide with ethylene oxide and mixtures thereof. When combinations of emulsifying agents are used, it is advantageous to use a relatively hydrophobic emulsifying agent in combination with a relatively hydrophilic agent. The amount of emulsifying agent is generally from about 1 to 10, preferably from about 2 to about 8, weight percent of the monomers used in the polymerization.

The emulsifier used in the polymerization can also be added in its entirety to the initial charge to the polymerization zone or a portion of the emulsifier, e.g., from 25 to 90 percent thereof, can be added continuously or intermittently during polymerization.

Various protective colloids may also be used in place of or in addition to the emulsifiers described above. Suitable colloids include partially acetylated polyvinyl alcohol, e.g., up to 50 percent acetylated, casein, hydroxyethyl starch, carboxylmethyl cellulose, gum arabic, and the like, as known in the art of synthetic emulsion polymer technology. In general, these colloids are used at levels of 0.05 to 4% by weight based on the total emulsion.

The polymerization reaction is generally continued until the residual vinyl acetate monomer content is below about 1%. The completed reaction product is then allowed to cool to about room temperature, while sealed from the atmosphere.

The emulsions are produced and used at relatively high solids contents, e.g., between 35 and 70%, preferably not less than 50%, although they may be diluted with water if desired.

The particle size of the latex can be regulated by the quantity of nonionic or anonic emulsifying agent or protective colloid employed. To obtain smaller particles sizes, greater amounts of emulsifying agents are used. As a general rule, the greater the amount of the emulsifying agent employed, the smaller the average particle size.

The vinyl acetate-ethylene-maleate-N-methylol containing binders described above are suitably used to prepare nonwoven fabrics by a variety of methods known to the art which, in general, involve the impregnation of a loosely assembled web of fibers with the binder latex, followed by moderate heating to dry the web. In the case of the present invention this moderate heating also serves to cure the binder, that is, by forming a crosslinked interpolymer. Before the binder is applied it is optionally mixed with a suitable catalyst for the N-methylol groups present as comonomer and thermoset. Thus, acid catalysts such as mineral acids, e.g., HCl, or organic acids, e.g., oxalic acid, or acid salts such as ammonium chloride, are suitably used, as known in the art. The amount of catalyst is generally about 0.5 to 2% of the total resin.

It may also be desirable to improve the strength of the mononer using such lower levels of the N-methylol containing monomers as will provide for extremely soft materials. This may be accomplished by replacing 0.5 to 5% by weight of the latex binder solids with an N-methylol containing thermoset polymer. Typical examples of these thermoset polymers are monoethylolmelamine, dimethylolmelamine. trethylolmelamine, tetramethylolmelamine, pentamethylolmelamine, hexamethylolmelamine, N-methoxymethyl N'-methylolmelamine, dimethylolethylene urea, monomethylol urea, dimethylol urea, dimethylolethyltriazone, dimethylolhydroxyethyltriazone, tetramethylolacetylene diurea, dimethylolpropylene urea, dimethyloldihydroxyethylene urea, N-butoxymethyl N-methylol urea and N-methoxymethyl N-methylol urea.

Additionally, there may also be present in the latex binders other additives conventionally employed in similar binders including defoamers, pigments, catalysts, wetting agents, thickeners, external plasticizers, etc. The choice of materials as well as the amounts employed are well known to those skilled in the art. These materials may be added just before application, if their stability in the dispersion or solution is low, or they may be formulated into the aqueous dispersion of the binder and stored if the stability in aqueous dispersion is high.

The starting fibrous web can be formed by any one of the conventional techniques for depositing or arranging fibers in a web or layer. These techniques include carding, garnetting, air-laying, and the like. Individual webs or thin layers formed by one or more of these techniques can also be lapped or laminated to provide a thicker layer for conversion into a heavier fabric. In general, the fibers extend in a plurality of diverse directions in general alignment with the major plane of the overlapping, intersecting and supporting one another to form an open, porous structure. When reference is made to "cellulose" fibers, those fibers containing predominately $C_6H_{10}O_5$ groupings are meant. Thus examples of the fibers to be used in the starting web are the natural cellulose fibers such as wood pulp, and chemically modified celluloses such as regenerated cellulose. Often the fibrous starting web contains at least 50% cellulose fibers, whether they be natural or synthetic, or a combination thereof. Other fibers in the starting web may comprise natural fibers such as wool; artificial fibers such as cellulose acetate; synthetic fibers such as polyamides, i.e., nylon, polyesters, i.e., "Dacron", acrylics, i.e., "Dynel," "Acrilan," "Orlon," polyolefins, i.e., polyethylene, polyvinyl chloride, polyurethane, etc., alone or in combination with one another.

The fibrous starting layer or web suitably weighs from about 5 to 65 grams per square yard and generally weighs about 10 to 40 grams per square yard. This fibrous starting layer, regardless of its method of preparation, is then subjected to at least one of the several types of latex bonding operations to anchor the individual fibers together to form a self-sustaining web. Some of the better known methods of bonding are overall impregnation, spraying or printing the web with intermittent or continuous straight or wavy lines or areas of binder extending generally transversely or diagonally across the web additionally, if desired, along the web.

The amount of binder, calculated on a dry basis, applied to the fibrous starting web suitably ranges from about 10 to about 100 parts or more per 100 parts of the starting web, and preferably from about 20 to about 45 parts per 100 parts of the starting web. The impregnated web is then dried and cured. Thus, the fabrics are suitably dried by passing them through an air oven or over a series of heated cans or the like and then through a curing oven or sections of hot cans. Ordinarily, convection air drying is effected at 65°-95° C. for 2-6 min., followed by curing at 145 °-155° C. for 1-5 min. or more. However, other time-temperatures relationships can be employed as is well known in the art, with shorter times at higher temperatures or longer times at lower temperatures being used. For example, the curing step can be carried out at about 135° C. for about 15 minutes or more in a laboratory or pilot line but may require only 2 to 20 seconds on high pressure high efficiency steam cans used in high speed production. If desired, the drying and curing can be effected in a single exposure or step.

The following examples are given to illustrate the present invention but it will be understood that they are intended to be illustrative only and not limitative of the invention. In the examples, all parts are by weight unless otherwise indicated.

The procedures utilized to prepare the binders produced in the examples are as follows:

EXAMPLE I

To a 10 liter autoclave was charged 675 g. (of a 20% w/w solution in water) sodium alkyl aryl polyethylene oxide sulphate (3 moles ethylene oxide), 50 g. (of a 70% w/w solution in water) alkyl aryl polyethylene oxide (30 moles ethylene oxide), 60 g. (of a 25% w/w solution in water) sodium vinyl sulphonate, 0.5 g. sodium acetate, 2 g. sodium formaldehyde sulphoxylate, 5 g. (of a 1% w/w solution in water) ferrous sulphate solution and 1900 g. water. After purging with nitrogen, 2250 g. vinyl acetate and 750 g. di-2-ethylhexyl maleate were charged to the reactor. The reactor was then pressurized to 750 psi with ethylene and equilibrated at 50° C. for 15 minutes. The polymerization was then started by metering in a solution of 60 g. tertiary butyl hydroperoxide in 290 g. water and 45 g. sodium formaldehyde sulphoxylate and 2 g. sodium acetate in 225 g. water over a period of 5 hrs. uniformly. Also added over 4 hrs. was a solution of 150 g. of N-methylol acrylamide (48% solution in water) and 75 g. of acrylic acid in a total of 250 g. of water.

Once the addition of the initiators was started, the reaction temperature was raised to 80°-82° C. and kept at this temperature until the reaction was completed. At the end of the initiator slow additions, the product was transferred to an evacuated vessel (30 liter) to remove residual ethylene from the system. It was identified as Emulsion 1.

Using the general procedure described above, additional emulsions were prepared varying the amounts and/or monomeric compositions. The major monomers and their respective amounts by weight are shown in Table I.

TABLE I

| Emulsion No. | VA | DEHM | DBM | E | NMA | AA |
|---|---|---|---|---|---|---|
| 1 | 60 | 20 | — | 20 | 2 | 2 |
| 2 | 50 | 30 | — | 20 | 2 | 2 |
| 3 | 62.5 | — | 17.5 | 20 | 3 | — |
| 4 | 40 | — | 40 | 20 | 3 | — |

Monomer Key:
VA = Vinyl Acetate
E = Ethylene
DEHM = Di-2-Ethylhexylmaleate
NMA = N—Methylol Acrylamide
DBM = Di-n-butyl Maleate
AA = Acrylic Acid For comparative purposes, two additional binders were prepared and tested. Binder A is representative of the binders of copending application Ser. No. 749,208 and contained 42.5 parts vinyl acetate, 42.5 parts butyl acrylate, 15 parts ethylene and 3 parts N-methylol acrylamide. Binder B was an all-acrylic system prepared with 70 parts butyl acrylate, 30 parts ethyl acrylate and 3 parts N-methylol acrylamide.

In preparing samples for testing, lengths of 15 gram per square yeard polyester were saturated using a Butterworth Padder and a batch of 100 parts of binder, 2 parts surfactant, 1 part catalyst, 2 parts melamine formaldehyde thermoset and sufficient water to give a 25% solids dilution, with a dry pick up of approximately 40 to 45 parts binder per 100 parts polyester web. The saturated web was dried for 2 minutes at 145° C. in a laboratory contact drier.

The tensile tests were run on a standard Instron tester set at 3 inch gauge length and 5 inch crosshead speed. The wet tensile was run after soaking specimens one minute in a 0.5% solution of Aerosol OT wetting agent. Results shown reflect the average of 10 tests.

The softness or hand of a nonwoven is difficult to test using quantitative techniques. In the case of the nonwoven samples tested herein, a panel test was also run to determine the relative softness by rating the samples in order of softest to firmest by feeling the drape and pliability of the samples. The softest sample was rated as 1, the next a 2, etc., for the total numbers tested. The results reported show the average of five panelist ratings for each sample.

The results obtained by testing the binders of Examples 1–4 as well as Comparative Binders A and B are shown in Table II.

TABLE II

| Emulsion | TENSILE STRENGTH DRY (lbs./inch) | WET (lbs./inch) | % Wet/Dry | HAND |
|---|---|---|---|---|
| 1 | 0.98 | 0.80 | 81% | 3.8 |
| 2 | 0.74 | 0.65 | 88% | 1.8 |
| 3 | 1.28 | 0.78 | 61% | 4.6 |
| 4 | 0.94 | 0.69 | 73% | 3.6 |
| A | 0.73 | 0.52 | 71% | 2.0 |
| B | 0.82 | 0.59 | 72% | 2.4 |

The results presented in Table II show the benefits of the present invention with respect to maximizing the balance of the contradictory properties of softness and strength needed for nonwoven applications. Thus, a comparison of the binders prepared with Emulsions 1, 2 and 4 versus the control shows that strength values superior to those achieved with the binders of the prior art can achieved herein without substantially effecting the hand. The binder prepared with Emulsion 3 containing lower levels of dibutyl maleate, while showing an increase in the dry tensile strength, gave the firmest hand or stiffness of the samples tested making these binders preferred for applications where durability and not hand is the prime consideration. It is also noted from a comparison of the % wet/dry values that the nonwovens prepared with the binders of the invention show a high retention of their strength properties even after wetting.

Similar results would be obtained using binders prepared with other maleates in the $C_4$–$C_{10}$ range such as as well as the corresponding fumarates.

It will be apparent that various changes and modifications may be made in the embodiments of the invention described above, without departing from the scope of the invention, as defined in the appended claims, and it is intended therefore, that all matter contained in the foregoing description shall be interpreted as illustrative only and not a limitative of the invention.

We claim:

1. A nonwoven fabric formed from a loosely assembled web of fibers bonded together with an aqueous emulsion; said aqueous emulsion being prepared by the emulsion polymerization of a vinyl ester of an alkanoic acid interpolymerized with:

(a) 10 to 30% by weight ethylene;
(b) 15 to 40% by weight of a $C_4$–$C_{10}$ dialkyl maleate or the corresponding fumarate;
(c) 1 to 5% by weight of copolymerizable N-methylol containing monommer;
(d) 0 to 4% by weight of an olefinically-unsaturated carboxylic acid containing 3 to 6 carbon atoms; and
(e) 0 to 1% by weight of a polyolefinically unsaturated comonomer.

2. The nonwoven fabric of claim 1 wherein the vinyl ester in the emulsion is vinyl acetate.

3. The nonwoven fabric of claim 1 wherein the N-methylol containing monomer in the emulsion is N-methylolacrylamide.

4. The nonwoven fabric of claim 1 wherein the dialkyl maleate in the emulsion is a $C_6$–$C_{10}$ dialkyl maleate.

5. The nonwoven fabric of claim 4 wherein the dialkyl maleate in the emulsion is a $C_8$ dialkyl maleate.

6. The nonwoven fabric of claim 5 wherein the dialkyl maleate in the emulsion is di-2-ethylhexyl maleate.

7. The nonwoven fabric of claim 1 wherein the dialkyl maleate in the emulsion is present in an amount of at least 20% by weight.

8. The nonwoven fabric of claim 1 wherein there is additionally present in the aqueous emulsion 0.5 to 5% by weight of an N-methylol containing thermoset polymer.

9. The nonwoven fabric of claim 1 wherein the aqueous emulsion contains up to 4% by weight of an olefinically unsaturated carboxylic acid selected from the group consisting of acrylic acid, methacrylic acid, crotonic acid, itaconic acid, maleic acid and fumaric acid.

10. The nonwoven fabric of claim 10 wherein the olefinically unsaturated acid in the emulsion is present in an amount of 1 to 2.5% by weight.

11. The nonwoven fabric of claim 1 wherein the aqueous emulsion contains up to 1% by weight of a polyunsaturated copolymerization monomer selected from the group consisting of vinyl crotonate, allyl acrylate, allyl methacrylate, diallyl maleate, divinyl adipate, diallyl adipate, diallyl phthalate, ethylene glycol diacrylate, ethylene glycol dimethacrylate, butanediol dimethacrylate, methylene bisacrylamide and triallyl cyanurate.

12. The nonwoven fabric of claim 1 comprising a loosely assembled web of hydrophobic fibers for use as a facing in disposable constructions.

13. The nonwoven fabric of claim 1 wherein the binder is present in an amount of 20 to 45 parts dry weight per 100 parts fiber.

14. A process for forming a nonwoven fabric from a loosely assembled mass of fibers comprising of steps of:

(i) bonding the fibers with an aqueous emulsion binder said binder prepared by the emulsion polymerization of:
  (a) 10 to 30% by weight ethylene;
  (b) 15 to 40% by weight of a $C_4$–$C_{10}$ dialkyl maleate or the corresponding fumarate;
  (c) 1 to 5% by weight of copolymerizable N-methylol containing monomer;
  (d) 0 to 4% by weight of an olefinically-unsaturated carboxylic acid containing 3 to 6 carbon atoms; and
  (e) 0 to 1% by weight of a polyolefinically unsaturated comonomer; and
(ii) heating to remove the water and cure the binder.

15. The process of claim 14 wherein the dialkyl maleate in the emulsion is a $C_6$–$C_{10}$ dialkyl maleate.

16. The process of claim 14 wherein the dialkyl maleate in the emulsion is a $C_8$ dialkyl maleate.

17. The process of claim 14 wherein the dialkyl maleate in the emulsion is present in an amount of at least 20% by weight.

18. The process of claim 14 wherein the vinyl ester is vinyl acetate, the copolymerizable methylol containing monomer is N-methylol acrylamide and the dialkyl maleate is di-2-ethylhexyl maleate.

19. The process of claim 14 wherein the curing is affected utilizing an acid catalyst.

20. The process of claim 14 where there is additionally present in the aqueous emulsion 0.5 to 5% by weight of an N-methylol containing thermoset polymer.

* * * * *